US005412950A

United States Patent [19]

Hu

[11] Patent Number: 5,412,950

[45] Date of Patent: May 9, 1995

[54] ENERGY RECOVERY SYSTEM

[76] Inventor: Zhimin Hu, 101 Natick Ave., Cranston, R.I. 02921

[21] Appl. No.: 97,974

[22] Filed: Jul. 27, 1993

[51] Int. Cl.[6] ..... F25B 9/00; F25J 3/00

[52] U.S. Cl. ..... 62/6; 62/11; 62/86; 62/87; 62/467

[58] Field of Search ..... 62/6, 11, 86, 87, 401, 62/467

[56] References Cited

U.S. PATENT DOCUMENTS

| | | | |
|---|---|---|---|
| Re. 31,683 | 9/1984 | Bauer | 239/614.06 |
| 962,836 | 6/1910 | Hildebrandt | 62/11 X |
| 1,027,862 | 5/1912 | Von Linde | 62/11 X |
| 2,524,397 | 10/1950 | Roberts et al. | 62/11 |
| 2,765,045 | 10/1956 | Meyers | 208/340 |
| 2,825,204 | 3/1958 | Kadosch et al. | 60/263 |
| 3,200,607 | 4/1965 | Williams | 62/86 X |
| 3,314,244 | 4/1967 | Green | 62/86 X |
| 3,526,099 | 9/1970 | Pavlin et al. | 62/467 X |
| 3,541,801 | 11/1970 | Marchal et al. | 62/467 |
| 3,559,373 | 2/1971 | Garrett | 62/11 X |
| 3,653,225 | 4/1972 | Marchal et al. | 62/467 |
| 3,828,574 | 8/1974 | Boy-Marcotte et al. | 62/467 |
| 3,865,143 | 2/1975 | Curto et al. | 137/826 |
| 3,889,484 | 6/1975 | Van Der Horst et al. | 62/86 X |
| 3,904,514 | 9/1975 | Marchal et al. | 62/11 X |
| 4,231,519 | 11/1980 | Bauer | 239/102 |
| 4,383,423 | 5/1983 | Lenglet et al. | 62/467 |
| 4,444,019 | 4/1984 | Arkiharov et al. | 62/87 |
| 4,458,708 | 6/1984 | Leoard | 137/9 |
| 4,495,967 | 2/1985 | Needham et al. | 137/614.06 |
| 4,504,285 | 3/1985 | Modisette | 62/467 X |
| 4,531,371 | 7/1985 | Voronin et al. | 62/11 X |
| 4,549,567 | 10/1985 | Herten | 137/262 |
| 4,562,867 | 6/1986 | Stouffer et al. | 137/811 |
| 4,625,517 | 12/1986 | Miller | 60/721 |
| 4,722,201 | 2/1988 | Hofler | 62/467 |
| 4,858,441 | 8/1989 | Wheatley et al. | 62/6 |
| 4,905,909 | 3/1990 | Woods | 239/589.1 |
| 4,953,366 | 9/1990 | Swift et al. | 62/467 |

*Primary Examiner*—Christopher Kilner

[57] ABSTRACT

This invention is a gas wave refrigeration method and a corresponding device used in an energy recovery system, which employs a mechanism creating a pulsating flow wave resonant interactions to generate cooling and heating effects without any mobile parts used in the device. The said system includes a precooler, a gas-liquid separator, and a gaseous wave refrigeration device (GWRD). The GWRD consists of a flow buffering chamber, a convergent nozzle, a oscillating chamber, resonant tubes, and a flow stabilizer. The operation of the GWRD is based on a pulsating flow production created by wave interactions between laterally oscillating high speed jets and resonant tubes. Such method of the pulsating flow production omits a conventional bistable element or other flow switching elements used in prior similar devices. A longitudinal resonating phenomenon of resonant tubes which provides a energy transformation and cooling effect is produced simultaneously by such wave interaction process. By means of this method and device, the energy recovery system provides an effective operation in a wide range of working conditions of pressurized gases in separation and liquefaction applications.

14 Claims, 6 Drawing Sheets

ENERGY RECOVERY SYSTEM

BACKGROUND OF THE INVENTION

This invention employs a gaseous wave refrigeration method and has its application in a low temperature separation process by energy recovery of pressurized gases. This invention is designed to generate cooling and heating effects by the use of the resonant periodic flow phenomenon and wave interactions in the gaseous wave refrigeration device of the system.

In traditional chemical and petroleum industries, numerous gaseous refrigeration processes and systems are applied in the operations of condensation, separation, liquefaction, and refining. Generally, cooling capacities in those systems are provided by gaseous expansion equipment, such as turbines and piston expanders operated under pressurized gases. Although gaseous expansion machines used in conventional energy convening systems have high efficiency, they require steady working conditions and a proper range of pressure drop ratio and flow rate. Such requirements of working condition, associated with their complicated mobile mechanical structures, result in high initial investment and considerable maintenance cost. Therefore, in many practical cases where gases are discharged with a high pressure drop ratio and a small flow rate, and where working conditions are fluctuating with losses of pressure energy, these traditional refrigeration systems and devices work with lower efficiency or ineffectiveness. Generally, to achieve the pressure reduction in the special technical process, a simple throttling valve is employed instead of traditional refrigeration machines but this is achieved at the cost of pressure energy loss for the capacity of system to work under extreme working conditions and its structural simplicity.

On the other hand, during the last few decades, due to the development of new technological processes, the shortage of energy resources, and worldwide protection of the environment, there has been an increasing interest in developing new refrigeration methods and systems that work under some special conditions, including high ratio of pressure drop or variable operating condition in order to replace inefficient traditional equipment and possess merits of simple structure, no leakage of the harmful materials, low initial investment, and low maintenance cost. Considerable improvements have been made in this field for consideration of high effective operation or recovering energy. One of the successful methods is to create cooling effect by means of gaseous wave interaction and interchange in periodic unsteady flows as is employed by U.S. Pat. Nos. 3,541,801, 3,653,225, 3,828,574, 4,625,517, and 4,722,201. In U.S. Pat. No. 3,541,801, the periodic gaseous motion in the receiving tubes is created by means of a bistable sonic oscillator instead of the reciprocating motion of the piston for a pulsating flow production. However, because such an operation is based on a simple combination of receiving tubes with fluidic bistable control elements, the apparatus of U.S. Pat. No. 3,541,801 works only with two resonant tubes and on very limited scale of mass flow rate and geometrical size. In the system of U.S. Pat. No. 3,828,574, a similar working process is accomplished by a mobile mechanical device called a rotary distributor. Such a device relies on a complex sealing structure with some moving parts which lead to a limited lives, a possibility of leakage of working fluid, a necessary requirement of special lubrication of parts, and high maintenance cost. Patents, as was mentioned above, (U.S. Pat. Nos. 3,541,801, 3,828,574) both use the phenomenon of pulsating flow to produce cooling and heating effects. In other systems such as U.S. Pat. Nos. 4,625,517 and 4,722,201, periodic thermal advection and the thermoacoustic oscillation are induced by means of a stack of thin, well-spaced stainless-steel plates and a set of spaced apart copper strips which convert heat energy absorbed from the high temperature heat source into acoustic power for pumping heat from one low temperature source at the system's one end to a high temperature sink at the other end of the system. Both systems described in U.S. Pat. Nos 4,625,517 and 4,722,201 provide a similar method which utilizes directly heat energy absorbed from high temperature environment to create acoustic resonant phenomenon, and extract heat from a cold space for supplying a cooling effect.

In summary, the prior patents have some serious limitations in terms of their efficiency and scope of applications. First, although there are several forms of gaseous refrigeration system which used a pulsating flow for refrigeration as reported in prior an patents, it is difficult to find an effective device which has enough cooling capacity, is free of complex structure and moving parts, and is suitable for the scale of flow in industry practice. Second, it is also very difficult for the aforementioned types of gaseous cooling devices to work effectively (or to be more specific, they will be limited in capacity, and won't have the required stable operation) on some particular operating condition, especially in the case of the high pressure drop ratio with small flow rate and unsteady operating conditions. Therefore, these and other difficulties experienced with prior art system and the needs of engineering applications have been motivated in a novel manner of the present invention.

Compared to traditional refrigeration equipment and the types of gaseous wave refrigeration machines aforementioned, the present invention, for its primary object, introduces a method which works by the a new mechanism of pulsating flow production which provides a resonant gaseous wave cooling processes and overcomes the limitations and weak points of conventional machines. A steady effective operation in applicants apparatus is based on such special operating mechanism of a pulsating flow production and designed structure for such an aim to be used effectively in separation and liquefaction for pressure energy recovery and reuse from pressurized gases in industrial settings. Such a method is especially suited for some special technological processes in industries where the high pressure energy is wasted. Therefore, the gases wave refrigeration method accompanied with energy recovery system of the present invention provide an effective operation for the following processes: a), where exhausting natural gases rush out with crude oil extraction under the conditions of a high pressure drop ratio, low and unsteady mass flow rates during the initial stage of oil extraction, so that it is difficult for the discharged gases to be collected and processed in such a flow state; b), where pressurized waste gases, which may contain some pressure energy as well as some harmful or pollutant components but that could be worth recovering as raw chemical materials in some special technological processes of chemical, petroleum and oil refined industries, are discharged and burnt; where the pressure reduction of a working fluid for the requirement of special technical processes with a steady or variable flow condition is completed by means of a throttle valve in which the pressure energy in the working fluid is dissipated by the throttling effect; c), where some special gaseous refrigeration processes with direct recirculation of refrigerant are required.

In short, present invention aims at meeting several important objects. The first is to provide a gases wave refrigeration method and apparatus with an energy recovery system for applying in the case where traditional expansion machines can not be used or are used with the price of low efficiency.

The second is the provision of a gases wave refrigeration method and apparatus with an energy recovery system for recovering the high pressure energy from the industrial discharge of gases.

The third is the provision of a gases wave refrigeration method with an energy recovery system for a wellhead processing system for recovering the valuable hydrocarbon compositions from discharged associated natural gases during the initial stage of extraction in either off-shore or isolated land oilwell extraction, wherein generally it is so hard to gather and process those gases because of the high pressure difference, low flow ratio or fluctuating operating condition that those natural gases have to be burned out to protect the environment and to prevent the explosion.

The fourth is to provide a gases wave refrigeration method with an energy recovery system to collect the harmful or polluting compositions from the pressurized waste gases in chemical, petroleum, and oil refining industries.

The fifth is to provide a gases wave refrigeration method for the special gaseous refrigeration processes where the refrigerant is circulated directly without the need of recycle by passing a heat exchanger.

The sixth is the provision of a gases wave refrigeration method with a device to replace throttle valves so that the system may work normally under the working conditions of high pressure drop ratio with unsteady mass flow rate.

The last is to provide a gases wave refrigeration method and apparatus with an energy recovery system which is able to operate under the extreme high pressure drop by means of a multi-stage operation without using any moving parts, such as throttle valves in series.

With these and other objects in view, as will be apparent to those skilled in the art, the invention resides in the combination of parts set forth in the specification and covered by the claims appended hereto.

SUMMARY OF INVENTION

In general, the system of the present invention consists of a precooler in which an incoming pressurized gas is cooled for the separation and liquefaction by a returning flow from a GWRD in the system, a gas-liquid separator in which a separating operation is provided, and a GWRD, being as a core part on the present invention, which comprises a flow buffer chamber, a jet nozzle which renders a stable high speed jet through the pressurized gas expansion, a jet oscillating chamber which sustains a steady high speed jet oscillation, a flow stabilizer which reduces the mixture in the outflow of the resonant tube bundles, and a bundle of resonant tubes which produces and dominates a pulsating flow in the oscillating chamber, and converts the fluid kinetic energy into cooling and heating effect by the interaction of resonant waves. Generally stated, as a pressurized gas steadily flows into the system, first, it goes through the precooler in which a heat transfer process is experienced, the temperature of the pressurized gas is thus reduced below its dew point, and the pressurized gas becomes a two-phase flow. Then, the pressurized gas enters into the gas-liquid separator for condensing the portion of liquid in the pressurized gas. After flowing through the separator, the pressurized gas flows into the GWRD in which the gas pressure energy of is absorbed, and its cooling capacity is obtained. The gas outflow after releasing pressure energy from the GWRD returns into the shell path of precooler to cool the coming pressurized gas.

In the GWRD, which is the core part of the present invention, the pressurized gas steadily flows through the nozzle and forms a high speed jet to transform its pressure energy into the kinetic energy before the jet enters into the oscillating chamber. In entering the oscillating chamber, a special confined space, the high speed jet will be effected by the shear layer separation, the nonuniform flow entrainment, and the turbulent diffusion. Those processes make the jet deflect apart from the flowing direction of the nozzle exit. Then, the deflected high speed jet impacts with each of the resonant tubes downstream. Via this impact between the high speed jet and the resonant tubes, a feedback phenomenon of the pressure waves is produced along the high speed jet. As a result, this pressure feedback pushes the high speed jet moving around in the oscillation chamber. The mechanism which periodically generates this feedback process is depended upon the resonant tubes, and a structure including a stabilizer, geometrical shape of oscillating chamber, and length of the each resonant tube, are assigned to sustain a steady periodic jet oscillation process in the oscillating chamber. Beside providing feedback signals to the jet, the resonant tube bundles acts also as a part to convert the kinetic energy and pressure energy of the incident gas into a cooling effect at their open ends. Such a cooling process is accomplished by the periodic expansive waves in the open ends of the resonant tubes accompanied with a feedback effect on the moving jet, and the heating effect at the closed end of the resonant tube bundle produced by the periodic compressible waves. In order to eliminate outflow interference between the oscillating chamber and the resonant tube during the discharging process of the pressurized gas, a flow stabilizer is disposed at the outlet of the resonant tube bundles. When this device is normally operated, a steady periodic oscillating jet is created in the oscillating chamber by the manipulation of the resonant tubes. By the laterally self-sustained oscillating jet, the pressurized gas is distributed to each of resonant tube bundles in turn, and a resonant phenomenon of gas waves occurs in the each of the resonant tubes at an inherent resonant frequency. Based on the actions of expansion and compression waves in the resonant tube bundles of the GWRD, a steady cooling capacity is provided by the gas outflow to the precooler associated with the heating gain from the end region of the resonant tube bundles of the gaseous wave refrigeration device in the system. Thus, by the cooling gas flow, the operations of liquefaction and separation in the system are respectively accomplished in the precooler and the gas/liquid separator of the system via the recovery of the energy in the pressurized gas.

BRIEF DESCRIPTION OF THE DRAWINGS

The characteristics of the present invention, may be best understood by reference to one of its structural forms illustrated by the accompanying drawings in which.

DETAILED DESCRIPTIONS OF THE PREFERRED EMBODIMENT

Figure 1:
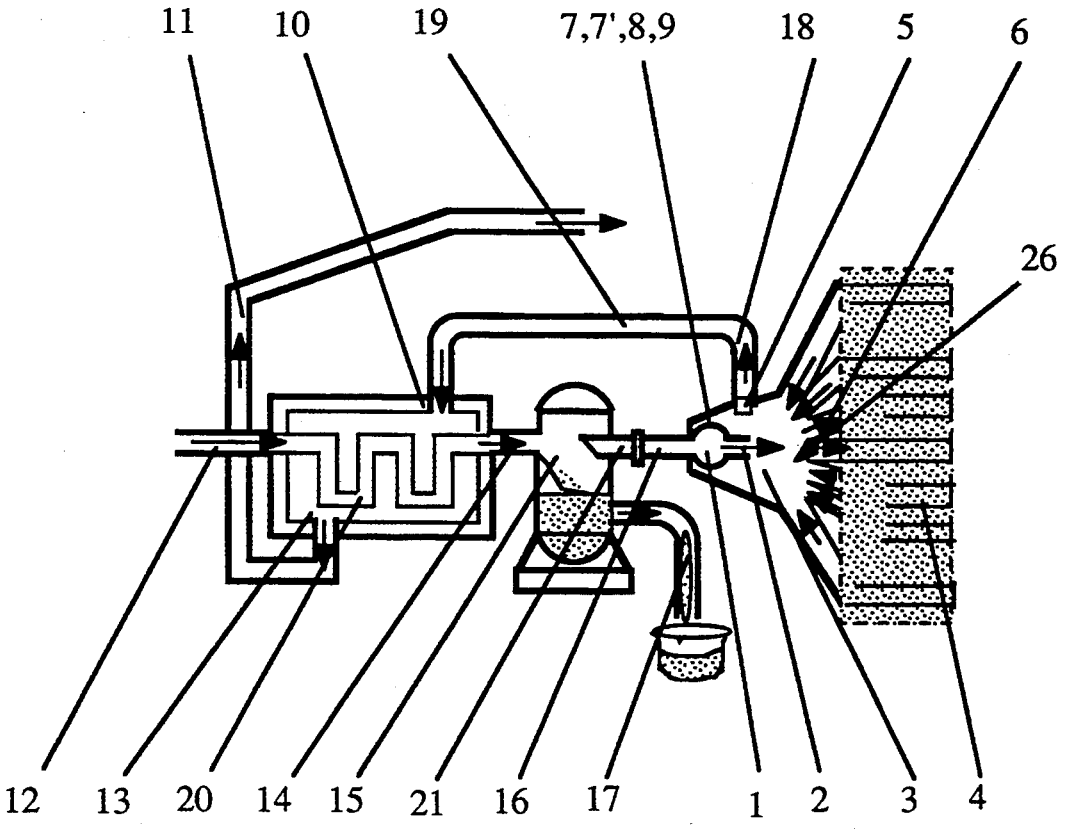
FIG. 1 is a schematic view of the energy recovery system using GWRD of the present invention.
Figure 2:
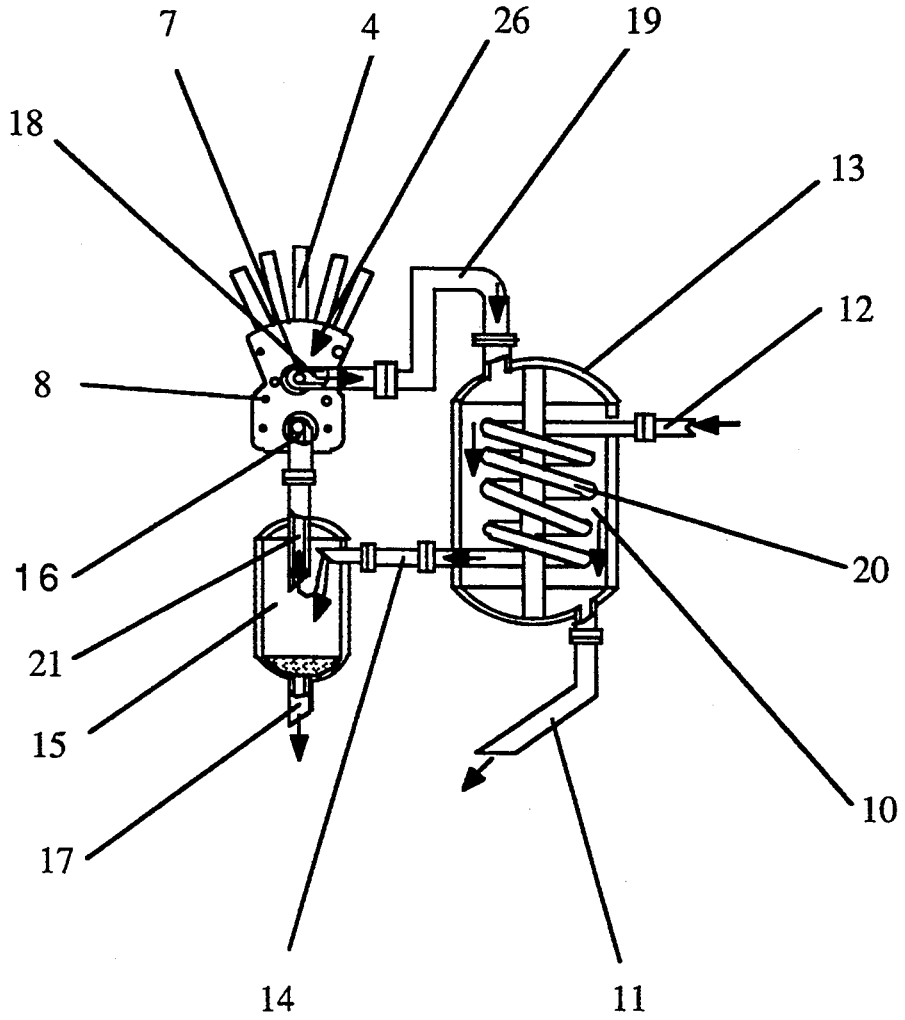
FIG. 2 is a plan view using GWRD of the present invention.

FIG. 1 best describes the general features of operating mechanism, the energy recovery system using GWRD of the present invention consists of a precooler 13, a GWRD 26 which is the core part in present invention, and a gas/liquid separator 15 which is located between the precooler 13 and the GWRD 26. An inflow conduit 20 extends through the precooler 13 in a serpentine mantier. The conduit 20 has an inlet end 12 for receiving hot pressurized gases and an outlet end 14 which extends into the gas/liquid separator 15 for conducting hot pressurized gases into the gas/liquid separator 15. A connecting conduits 21, seen also in FIG. 3, extends from the gas/liquid separator 15 to the pair of inlet conduits 16 of the GWRD 26 for conducting the pressurized gas from the gas/liquid separator to the GWRD 26. An outflow conduit which is generally indicated by the reference 19 conducts the gas from the GWRD 26 to the precooler 13, and an outlet conduit 11 is for discharging the gas. The outlet conduit 19 includes a pipe connecting 18 which extends from the stabilizer 5 of GWRD 26. The precooler 13 has a cylinder channel 10 within the precooler. The cylinder channel 10 contains the spiral configuration of the inflow conduit 20 to provide a heat exchange process between the gas flowing through the conduits 20 and the returning gas which flows through the cylinder channel 10. An outflow conduit 14 connected with the inflow conduit 20 extends to the gas/liquid separator 15. A discharge conduit 17 is positioned at the lower portion of the gas/liquid separator 15 for draining the liquid which is condensed from the incoming hot pressurized gas within the separator 15. The upper conduit 21 at the top of the gas/liquid 15 leads to the GWRD 26 in which the dry pressurized gas, separated, enters the pair of conduits 16 of device 26 by a forked portion.

Figure 3:
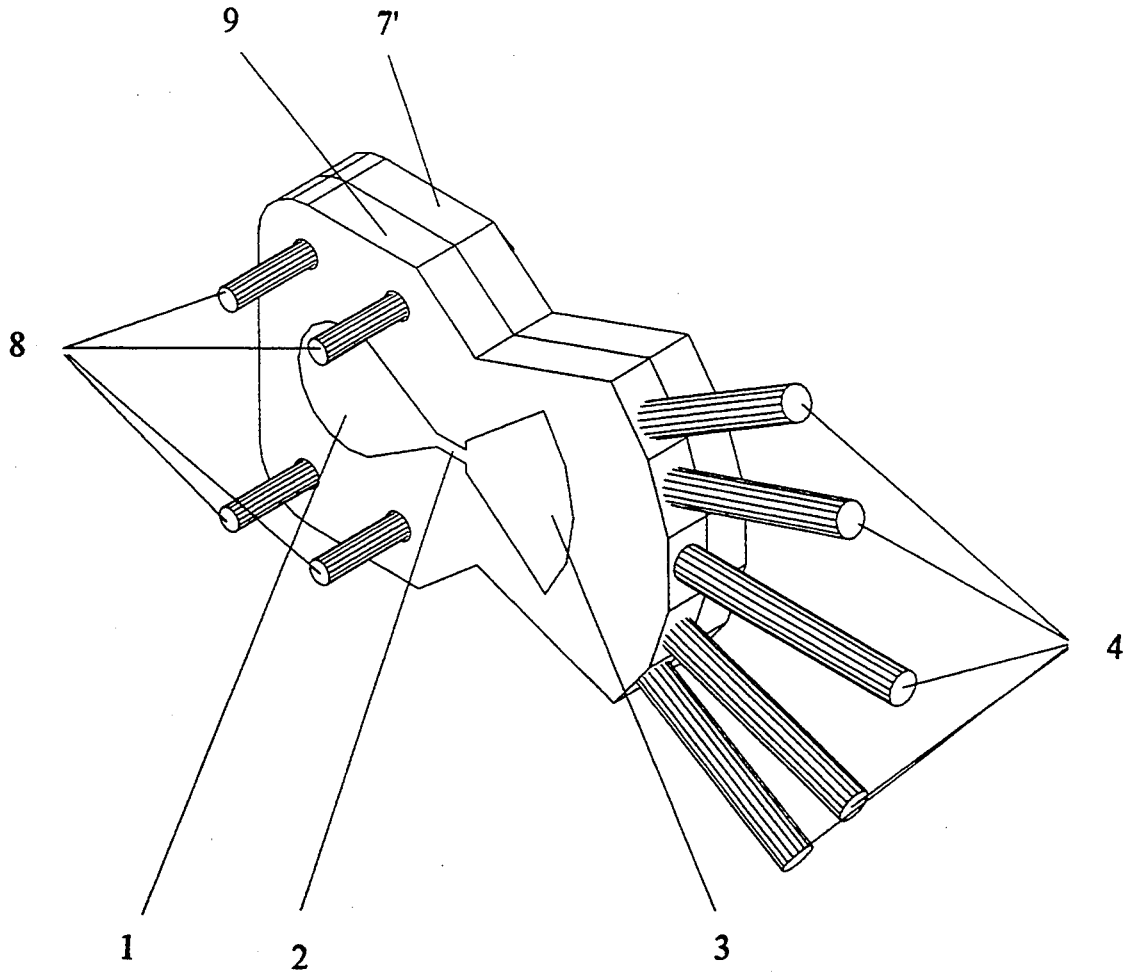
FIG. 3 is a perspective schematic view of the GWRD which forms pan of the present invention.
Figure 4:
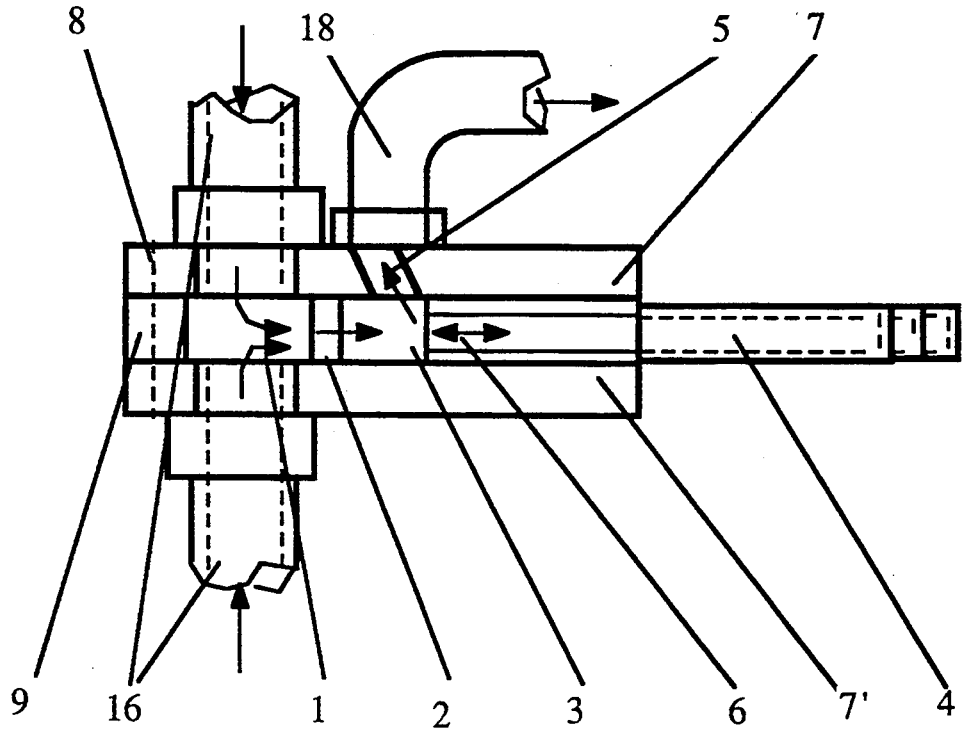
FIG. 4 is a side elevational view of the GWRD.
Figure 5:
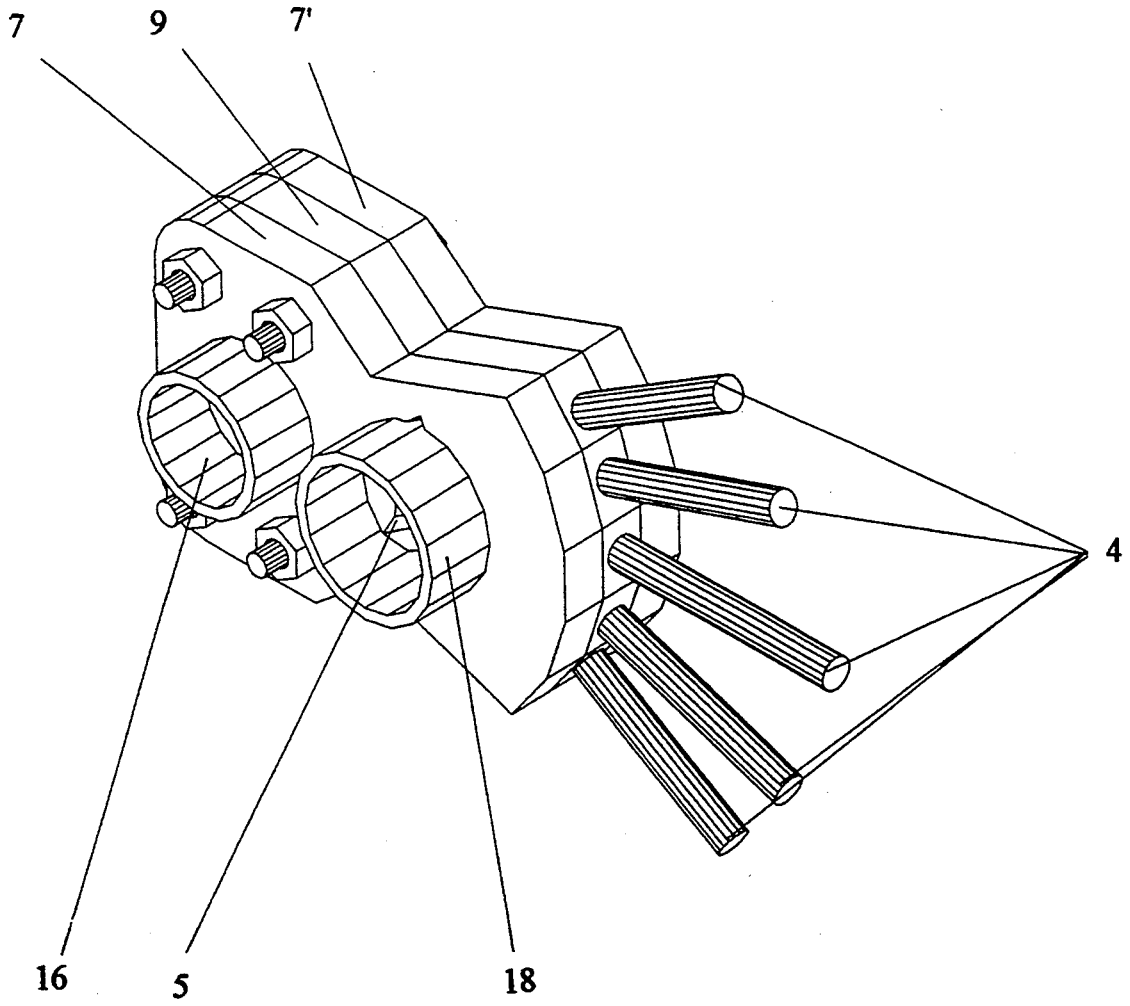
FIG. 5 is a second perspective view of the GWRD, an isometric view of the GWRD.
Figure 6:
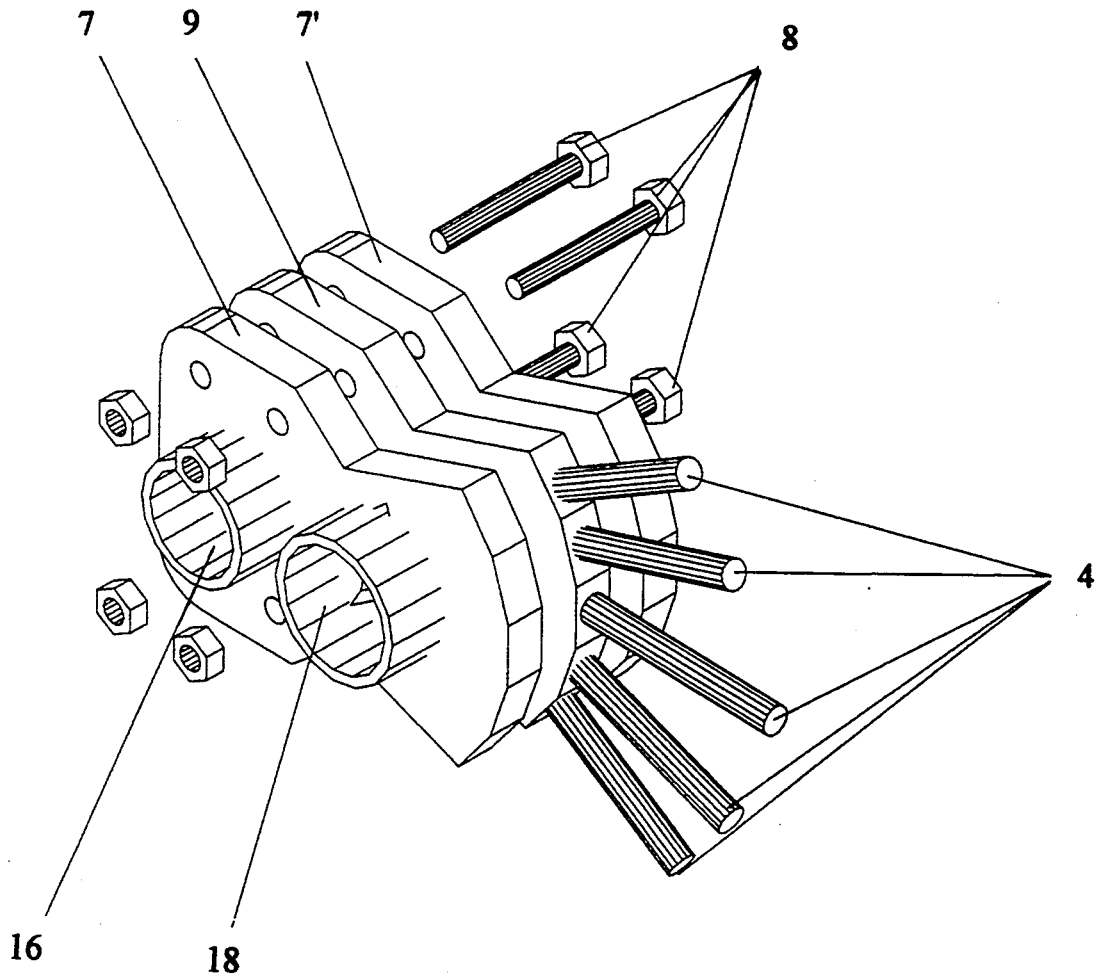
FIG. 6 is an exploded view of the GWRD.

The GWRD 26, a core device in the present invention shown in FIG. 3, FIG. 4 and FIG. 5, comprises a flow buffering chamber 1, a convergent nozzle 2 which is connected with the flow buffering chamber 1, an oscillating chamber 3 which is arranged in series of the convergent nozzle 2, a resonant tube bundle 4 which is connected to the oscillating chamber 3, and a flowing stabilizer 5. Referring to FIG. 3 and 4, the buffering chamber 1, the convergent nozzle 2, and the oscillation chamber 3 are formed within an operation plate 9. The upper surface of the plate 9 is covered by an upper covering plate 7. The lower surface of the plate 9 is covered by lower covering plate 7'. The flow stabilizer 5 is located within the upper plate 7 and connects the oscillating chamber 3 to the pipe connecting 18 of the outflow conduit. One of the connecting conduits 16 is connected to the buffering chamber 1 through the upper plate 7. The other connecting conduit 16 is connected to the chamber 1 through the lower plate 7'. The upper and lower plate 7 and 7', respectively, are connected to the plate 9 by bolts 8.

Again referring to FIG. 1, a pressurized gas from discharging source, first flows into the precooler 13 through the inlet of conduit 12. Within the precooler 13, the temperature of the incoming pressurized gas descends due to the heat transfer between the incoming pressurized gas inside the tube 20 and the cooling stream entering in the shell 10 of precooler 13 from the GWRD 26. By this process, the incoming pressurized gas is cooled to form a two-phase stream. Such two-phase stream is led to the gas/liquid separator 15 through the conduit 14 for a separation operation. Out of the gas/liquid separator 15, the gas phase of the pressurized gas flows into the GWRD 26. Then, the temperature of the gas is further reduced as the pressure energy of the pressurized gas is released in the device 26. The stream with the low temperature out of the GWRD 26, and returns into the precooler 13 through the outflow pipe connecting 18 and conduit 19. After the stream of the low temperature of the gas provides a cooling capacity for the incoming pressurized gas, it is discharged into the next process by passing through the outlet conduit 11. Finally, the gain from this system is that the useful chemical material is obtained from the gas/liquid separator 15 by means of the release of the pressure energy from the incoming pressurized gas in the GWRD 26. The operation of the GWRD 26, as a core part of the present invention, is described as following Referring primarily to FIG. 3, FIG. 4, FIG. 5 and FIG. 6, in which the outline of the GWRD 26 is indicated, both sides of the operating plate 9 are covered by the two covering plates 7 and 7'. They are tightened together by the four bolts 8. The two inflow conduits 16 are connected with respect to the covering plates 7 and 7' for the entry of the pressurized gas. The outflow conduit 18 is connected with the stabilizer 5 on the upper covering plate 7. When the pressurized gas flows into the GWRD 26, it first enters the buffering chamber 1 where the turbulence and vortex associated with the coming pressurized gas are eliminated by means of a flowing diffusion process and a symmetric inflow structure from the pair of conduits 16. As the high pressure buffered gas flows through the convergent nozzle 2, the pressure energy of the gas is convened into kinetic energy, and stream velocity gradually increases in the nozzle 2. With the pressurized gas rushing out of the nozzle 2 outlet, a high speed jet is formed in the oscillating chamber. As it is known, an enlargement of the geometric configuration from the nozzle 2 to the oscillating chamber 3 will result in flow separation and formation of the shear layer with high speed jet, which happen instantaneously at the outlet edge of nozzle 2. Meanwhile, the configuration of the confined space in the oscillating chamber 3 will influence the flowing direction of high speed jet. Therefore, Such a process produces an asymmetric jet flow in the outlet region of the nozzle 2, which makes the jet deflect to the either side of walls in the oscillating chamber 3. If no downstream boundary, such as the apertures of resonant tubes, is located in the oscillating chamber 3, the high speed jet will steadily stay in bending at the side where it went initially, and there is no pulsating flow to be create in this case for mentioned cooling process. As a matter of fact, the existence of the resonant tube bundles at downstream of the oscillating chamber 3 breaks the standing of the bending jet. As a result, when the bending jet reattaches at either side of the oscillating chamber and impacts with the one of resonant tube bundles 4 downstream, a fluid mass is accumulated instantaneously at the inlet region of those tubes. Such a process of mass accumulating results in a pressure impulse generated in the aperture of tube which is impacted by high speed jet. This strong pressure impulse has a simultaneous actions on the high speed jet which touches with said aperture of the tube in standing in the oscillating chamber 3 and the gaseous column inside the tube impacted by the high speed jet, one within the resonant tube bundles 4. The states of the gas positioned at the outlet of the nozzle 2 and in the resonant tube bundles 4 are changed instantaneously. The state variation in the outlet region of nozzle 2 generates the movement of the bending jet step by step in the oscillating chamber 3 as it moves over each of the open ends of resonant tube bundles. When the high speed jet moves to another side of the walls in the oscillating chamber 3, an identical process will repeatedly occur due to the influence of the resonant tubes 4 which impinged with bending jet again, a continuous lateral movement of the high speed jet will be produced, which is based on a continuous pressure feedback in such a impinging process occurred in the oscillating chamber 3. In consequence of the periodic generation and propagation of pressure impulse created by high speed jet impacting with resonant tubes, a lateral self-sustained oscillation of high speed jet is formed in the oscillating chamber 3. The other pan of the pressure impulsive wave apart from the inlet of the resonant tube moves toward the closed end of resonant tube 4. A compression process of the gas column near the closed end of resonant tube 4 will occur as the pressure impulsive wave arrives. The temperature of the gas column within the resonant tubes 4 increase as they are compressed, and the thermal energy of gas column compressed will be released to the surroundings by a heat transfer process through the wall of the resonant tubes 4 during this process. While the high speed jet moves away from the impacting region 6 of the corresponding resonant tube, an expansive wave is formed, and then, it moves into the closed end of the resonant tube bundles 4. This expansive wave acts on the portion of the incident gas injected by the moving high speed jet, which will simultaneously cause the reduction of the temperature in the portion of incident gas in the region 6 and the movement away from the inlet of resonant tube bundles 4 into the space of oscillating chamber 3. Then, by passing through the stabilizer 5, the portion of incident gas is discharged into the pipe connecting 18 of the outflow conduit 19. Since the portion of incident gas injected by the moving jet experiences the actions of the pressure impulsive wave and expansive wave which take the pressure energy out in the portion of injected gas, a cooling outflow of the incident gas is obtained in the outflow pipe connecting 18 positioned after the jet moving away.

Summarily speaking, because the generation and propagation of the periodic pressure impulsive wave in the shear layer of the high speed jet is depended on that the moving jet repeatedly sweeps over the each aperture of resonant tubes 4, it results in the jet oscillating laterally in the oscillating chamber 3. Meanwhile, the movement of the gaseous columns within the resonant tube bundles 4, associated with the energy transformation between the incident gas and the gaseous columns, will be supported in turn by such a impacting action with the moving jet in the region 6. Therefore, a closed loop of the feedback signal is formed in this process, and the periodic compressive and expansive impulsive waves are created with respect to the each of the resonant tube bundles 4 during the movement period of the moving jet. As a consequence, a periodic lateral resonant oscillation phenomenon of the moving jet is established in the oscillating chamber 3 with an inherent resonant frequency of resonant tubes who controls this process, and the noticeable cooling effect is continuously produced with the outflow gas in the stabilizer 5. In order to utilize effectively the oscillating gaseous columns 4 as a vehicle to effectively transport and convert the energy of the portion of the incident gas, a bundle structure of the resonant tubes each possessing a special length and diameter for providing an effective and order pressure feedback during its impingement with the high speed jet is employed for supporting said jet oscillation. A common bundle structure has the disadvantage of the outflow mixing in the region 6 among the open ends of the resonant tube bundles 4, which reduces the energy transforming efficiency, and breaks down the stability of the jet oscillating. To overcome this disadvantage, in present invention, a flow stabilizer 5 is designed in the present invention as shown in FIG. 3 and FIG. 4. Its function is to decrease the mixture of the cooled portion of the outflow gas with the incident gas in the oscillating chamber. This structure is positioned at the interspace between the inlet of the resonant tube bundle 4 which is manufactured in the upper covering plate 7 and the oscillating chamber. The functions of stabilizer 5 are described as follows: a) the portion of the incident gas from the high speed jet in the oscillating chamber 3, which has not arrived at the inlet of resonant tube bundle 4 before it releases the pressure energy into the gas column in the resonant tube impinged next, will be not discharge directly into the pipe connecting 18 of the outflow conduit 19 of the GWRD 26 from the oscillating chamber 3 due to the stuck effect of the external edge vortex created in the stabilizer 5; b) the cooled gas which undergoes the energy exchange process with the gas columns in the resonant tube bundle 4, will have a smooth outrush path by the propellant of the expansive waves out of the resonant tube bundle 4. It will decrease the mixture of the cold gas with the high speed jet in the oscillation chamber 3 during its moving. The stabilizer 5 has other special functions; for instance, balancing the operating load and the discharging state among the resonant tube bundle 4, reducing the mutual interferences in the working state among the gaseous columns, and preventing mixing from the back flow in the outlet region 6, which based on the position of stabilizer 5 crossing over the interspace between the oscillating chamber and the region of open ends of resonant tubes. Such a position makes outflow exhausting alternatively out of resonant tubes and high speed jet impinging on open ends of resonant tubes possess a same state which provides a identical wave refrigeration process.

As a result, the GWRD 26, will be operated under a pulsating flow production created by resonant tubes combined with the self-sustained lateral oscillation of the high speed jet in special structure of the GWRD 26. This makes the corresponding energy recovery system used GWRD 26 be able to work in a wide range of operating conditions, and has a higher efficiency owing. It is shown that in the experiment condition of higher than critical pressure drop ratio, the variation of working conditions is without the influence on the operation over a wide range, and the starting point of the self-sustained oscillation in the GWRD 26, which makes the system begin with the normal operation, is in a very low pressure different between the inflow and the outflow condition. The temperature increase (equivalent to the effectiveness of energy transformation) measured outside surface of the resonant tube bundles 4 is much higher than ambient temperature, and depends on the operating conditions. The temperature drop of outflow gas at the exit of the GWRD 26 is noticeably lower than the incoming pressurized gas.

The invention having been thus described, what is claimed as new and desired to secure by Letter Patent is:

1. A gaseous wave refrigeration apparatus comprising:

(a) a gaseous wave refrigeration apparatus having a convergent nozzle, an oscillating chamber connected to said convergent nozzle, a plurality of resonant tubes having open end connected at apertures to said oscillating chamber, and a flow stabilizer crossing over said oscillating chamber at the apertures of said resonant tubes, and (b) a resonant refrigeration means using a pulsating flow of a periodic jet oscillation from said convergent nozzle in said oscillating chamber driven alternatively by each of said resonant tubes, wherein said jet oscillation, maintained by a pressure positive feedback loop comprising said stabilizer and said resonant tubes, couples with the intrinsic resonant frequency of a gaseous column in said resonant tubes and governs a resonant cooling effect accompanied with said intrinsic resonant frequency of gaseous column in said resonant tubes.

2. The gaseous wave refrigeration apparatus as recited in claim 1, further comprising:

(a) an operating plate with an upper side and lower side, containing said convergent nozzle adjacent to one side of said oscillating chamber, and apertures formed as a certain number of holes with female thread at side an opposite of said operating plate for connecting said resonant tubes with male thread to said oscillating chamber, which provides a pulsing flow production and a resonant cooling effect, (b) an upper covering plate containing said stabilizer as a declivitous slot passage in a position crossing over said oscillating chamber adjacent the open ends of said resonant tubes, which covers the upper side of said operating plate, and provides a pathway for discharging gases after energy conversion from the open ends of said resonant tubes to an outflow conduit, and divides the jet stream before entering said resonant tubes from the discharging gases, and (c) a lower covering plate, which covers the lower side of said operating plate and wherein provides a two dimensional configuration for said convergent nozzle and said oscillating chamber.

3. The gaseous wave refrigeration apparatus as recited in claim 2, wherein said operating plate with provides a special geometrical shape for a pulsing flow production and a resonant cooling effect, and wherein said resonant tubes are of rigid metal material, of identical diameter and male thread at the open end for providing a connection to said oscillating chamber, and each tube of a slight different length thereby creating a frequency difference effect at open ends of said resonant tubes and leading to an alternative and orderly movement of said jet around in said oscillating chamber.

4. The gaseous wave refrigeration apparatus as recited in claim 2, wherein said operating plate provides a special geometrical shape for a pulsing flow production and a resonant cooling effect, and wherein said oscillating chamber in said operating plate is of a fan-shaped structure connected to said convergent nozzle with two converging sides with an offset at one end, with the other end forming an arc side of said fan-shaped structure of said oscillating chamber at the point where the open ends of said resonant tubes are connected to said oscillating chamber.

5. The gaseous wave refrigeration apparatus as recited in claim 2, wherein said operating plate provides a special geometrical shape for a pulsing flow production and a resonant cooling effect, and wherein said convergent nozzle further includes a buffering chamber means in a passage to said convergent nozzle in said operating plate for inducting pressurized gases to said convergent nozzle.

6. The gaseous wave refrigeration apparatus as recited in claim 2, wherein said stabilizer comprises two declivitous surfaces and an inclining slot passage crossing over the upper surface of interspace between said oscillating chamber and the open ends of said resonant tubes in said operating plate, said passage having a width approximately equivalent to the diameter of said resonant tubes, forming a 20–45 degree sharp angle with the upper surface of said operating plate in the direction of said convergent nozzle, and thereafter providing a smooth pathway for gases discharged from said resonant tubes to an outflow conduit after the energy of said gases is convened into heat in said resonant tubes.

7. An energy recovery system, comprising: a precooler, said gaseous wave refrigeration apparatus as defined in claim 2, and a gas/liquid separator which is located between said precooler and said gaseous wave refrigeration apparatus.

8. A gaseous wave refrigeration apparatus comprising:

(a) a gaseous wave refrigeration apparatus having a convergent nozzle, an oscillating chamber connected to said convergent nozzle, a plurality of resonant tubes having open connected at apertures to said oscillating chamber, and a flow stabilizer means crossing over said oscillating chamber adjacent the open ends of said resonant tubes, and (b) a resonant refrigeration means using a pulsating flow of a periodic jet oscillation from said convergent nozzle in said oscillating chamber driven alternatively by each of said resonant tubes, wherein said jet oscillation, maintained by a pressure positive feedback loop comprising said stabilizer means and said resonant tubes, couples with the intrinsic resonant frequency of a gaseous column in said resonant tubes and governs a resonant cooling effect accompanied with said intrinsic resonant frequency in said resonant tubes, and (c) wherein said stabilizer means eliminates mutual interference of discharging flow among open ends of said resonant tubes in said oscillating chamber, diminishes mutually mixing losses between discharging flow among the open ends of said resonant tubes and moving said jet in said oscillating chamber, balances flow load state among open ends of said resonant tubes, and forms a steady feedback loop of said jet oscillation in said oscillating chamber for said jet interchanging to sweep over the each open end of said resonant tubes.

9. The gaseous wave refrigeration apparatus as recited in claim 8, further comprising:

(a) an operating plate with an upper side and lower side, containing said convergent nozzle adjacent to one side of said oscillating chamber, and apertures formed as a certain number of holes with female thread at an opposite side of said operating plate for connecting said resonant tubes with male thread to said oscillating chamber, which forms a special geometrical shape and provides a pulsing flow production and a resonant cooling effect, (b) an upper covering plate containing said stabilizer means declivitous slot passage crossing over said oscillating chamber, which covers the upper side of said operating plate and provides a pathway for gases after energy conversion from said resonant tubes to a outflow conduit, and (c) a lower covering plate, which covers the lower side of said operating plate and wherein provides a two dimensional configuration for said convergent nozzle and said oscillating chamber.

10. The gaseous wave refrigeration apparatus as recited in claim 9, wherein said operating plate provides a pulsing flow production and a resonant cooling effect, and wherein said resonant tubes are of rigid metal material, of identical diameter and male thread at the open end for providing a connection to said oscillating chamber, and each tube of a slight different length thereby creating a frequency difference effect at open ends of said resonant tubes and leading to an alternative and orderly movement of said jet around in said oscillating chamber.

11. The gaseous wave refrigeration apparatus as recited in claim 9, wherein said operating plate provides a pulsing flow production and a resonant cooling effect, and wherein said oscillating chamber in said operating plate is of a fan-shaped structure connected to said convergent nozzle with two converging sides with an offset at one end, with the other end forming an arc side of said fan-shaped structure of said oscillating chamber at the point where the open ends of said resonant tubes are connected to said oscillating chamber.

12. The gaseous wave refrigeration apparatus as recited in claim 9, wherein said operating plate provides a pulsing flow production and a resonant cooling effect, and wherein said convergent nozzle further includes a buffering chamber means in a passage to said convergent nozzle in said operating plate for inducting pressurized gases to said convergent nozzle.

13. The gaseous wave refrigeration apparatus as recited in claim 9, wherein said stabilizer means comprises two declivitous surfaces and an inclining slot passage crossing over the upper surface of interspace between said oscillating chamber and the open ends of said resonant tubes in said operating plate, said passage having a width approximately equivalent to the diameter of said resonant tubes, forming a 20–45 degree sharp angle with the upper surface of said operating plate in the direction of said convergent nozzle, and thereafter providing a smooth pathway for gases discharged from said resonant tubes to an outflow conduit after the energy of said gases is converted into heat.

14. An energy recovery system, comprising: a precooler, said gaseous wave refrigeration apparatus as defined in claim 9, and a gas/liquid separator which is located between said precooler and said gaseous wave refrigeration apparatus.

* * * * *